US006173797B1

(12) United States Patent
Dykstra et al.

(10) Patent No.: US 6,173,797 B1
(45) Date of Patent: Jan. 16, 2001

(54) ROTARY DRILL BITS FOR DIRECTIONAL DRILLING EMPLOYING MOVABLE CUTTERS AND TANDEM GAGE PAD ARRANGEMENT WITH ACTIVE CUTTING ELEMENTS AND HAVING UP-DRILL CAPABILITY

(75) Inventors: Mark W. Dykstra, Kingwood, TX (US); James A. Norris, Sandy, UT (US); Christopher C. Beuershausen, Spring; Rudolf C. O. Pessier, Houston, both of TX (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/139,012

(22) Filed: Aug. 24, 1998

Related U.S. Application Data

(63) Continuation-in-part of application No. 08/924,935, filed on Sep. 8, 1997.

(51) Int. Cl.[7] ..... E21B 10/00; E21B 10/26

(52) U.S. Cl. ..... 175/374; 175/325.2; 175/331; 175/406; 175/408

(58) Field of Search ..... 175/325.2, 374, 175/406, 408, 331, 353, 356, 376

(56) References Cited

U.S. PATENT DOCUMENTS

| | | | | |
|---|---|---|---|---|
| 2,472,749 | * | 6/1949 | Lake | 175/406 |
| 2,553,701 | | 5/1951 | Comstock . | |
| 2,562,346 | * | 7/1951 | Whittaker | 175/406 |
| 3,318,400 | | 5/1967 | Hildebrandt . | |
| 3,322,218 | | 5/1967 | Hildebrandt . | |
| 3,367,430 | | 2/1968 | Rowley . | |
| 3,575,247 | | 4/1971 | Feenstra . | |
| 3,628,616 | | 12/1971 | Neilson . | |
| 3,820,611 | | 6/1974 | King . | |
| 3,825,081 | * | 7/1974 | McMahon | 175/325.2 X |
| 3,825,083 | | 7/1974 | Flarity et al. . | |
| 3,871,488 | | 3/1975 | Sabre . | |
| 3,938,853 | * | 2/1976 | Jurgens et al. | 166/241 X |
| 3,978,933 | | 9/1976 | Olson et al. . | |
| 4,031,974 | * | 6/1977 | Peterson | 175/334 |
| 4,073,354 | | 2/1978 | Rowley et al. . | |
| 4,221,270 | | 9/1980 | Vezirian . | |
| 4,244,432 | | 1/1981 | Rowley et al. . | |
| 4,246,977 | | 1/1981 | Allen . | |
| 4,385,669 | | 5/1983 | Knutsen . | |
| 4,429,755 | | 2/1984 | Williamson . | |
| 4,512,425 | | 4/1985 | Brock . | |
| 4,515,227 | * | 5/1985 | Cerkivnik | 175/393 X |
| 4,545,441 | | 10/1985 | Williamson . | |
| 4,558,753 | | 12/1985 | Barr . | |

(List continued on next page.)

FOREIGN PATENT DOCUMENTS

| | | |
|---|---|---|
| 0467580 A1 | 7/1991 | (EP) . |
| 0522553 A1 | 7/1991 | (EP) . |
| 2294071 | 4/1996 | (GB) . |

*Primary Examiner*—Eileen D. Lillis
*Assistant Examiner*—Jong-Suk Lee
(74) *Attorney, Agent, or Firm*—Trask Britt

(57) ABSTRACT

A rotary drill bit suitable for directional drilling. The bit includes a bit body from which extend legs carrying rotatable cutters. The body carries primary gage pads, above which secondary gage pads may be either longitudinally spaced or rotationally spaced, or both. Longitudinally leading edges of the gage pads may carry cutting structure for smoothing the sidewall of the borehole. Cutting structure may likewise be disposed on the trailing ends of the gage pads to provide an up-drill capability to facilitate removal of the bit from the borehole. The gage pads provide enhanced bit stability and reduced side cutting tendencies, as well as reducing lateral loading on the rotatable cutters and associated bearing structure and seals. The invention also has utility in bits not specifically designed for directional drilling.

29 Claims, 12 Drawing Sheets

U.S. PATENT DOCUMENTS

| | | | | |
|---|---|---|---|---|
| 4,593,777 | | 6/1986 | Barr . | |
| 4,602,691 | | 7/1986 | Weaver . | |
| 4,640,375 | | 2/1987 | Barr et al. . | |
| 4,673,044 | | 6/1987 | Bigelow et al. . | |
| 4,676,324 | | 6/1987 | Barr et al. . | |
| 4,714,120 | | 12/1987 | King . | |
| 4,792,000 | * | 12/1988 | Perkin et al. | 175/228 |
| 4,869,330 | | 9/1989 | Tibbitts . | |
| 4,874,045 | * | 10/1989 | Clayton | 175/325.2 X |
| 4,941,538 | | 7/1990 | King . | |
| 5,004,057 | | 4/1991 | Tibbitts et al. . | |
| 5,033,559 | | 7/1991 | Fischer . | |
| 5,033,560 | | 7/1991 | Sawyer et al. . | |
| 5,119,892 | | 6/1992 | Clegg et al. . | |
| 5,145,016 | * | 9/1992 | Estes | 175/374 X |
| 5,163,524 | | 11/1992 | Newton, Jr. et al. . | |
| 5,180,021 | * | 1/1993 | Champion et al. | 175/325.2 X |
| 5,234,063 | * | 8/1993 | Collinsworth | 175/325.2 |
| 5,415,243 | | 5/1995 | Lyon et al. . | |
| 5,443,565 | | 8/1995 | Strange, Jr. . | |
| 5,467,836 | | 11/1995 | Grimes et al. . | |
| 5,547,033 | * | 8/1996 | Compos, Jr. | 175/331 |
| 5,553,681 | * | 9/1996 | Huffstutler et al. | 175/374 X |
| 5,558,170 | | 9/1996 | Thigpen et al. . | |
| 5,601,151 | | 2/1997 | Warren . | |
| 5,651,421 | | 7/1997 | Newton et al. . | |
| 5,655,612 | | 8/1997 | Grimes et al. . | |
| 5,678,644 | | 10/1997 | Fielder . | |
| 5,755,297 | * | 5/1998 | Young et al. | 175/374 X |
| 5,904,213 | * | 5/1999 | Caraway et al. | 175/393 |
| 5,957,223 | * | 9/1999 | Doster et al. | 175/408 X |
| 5,992,547 | | 11/1999 | Caraway et al. . | |
| 5,996,713 | | 12/1999 | Pessier et al. . | |
| 6,000,483 | | 12/1999 | Jurewicz et al. . | |
| 6,006,845 | * | 12/1999 | Illerhaus et al. | 175/406 |
| 6,039,131 | | 3/2000 | Beaton . | |

* cited by examiner-

ROTARY DRILL BITS FOR DIRECTIONAL DRILLING EMPLOYING MOVABLE CUTTERS AND TANDEM GAGE PAD ARRANGEMENT WITH ACTIVE CUTTING ELEMENTS AND HAVING UP-DRILL CAPABILITY

CROSS-REFERENCE TO RELATED APPLICATION

This application is a continuation-in-part of U.S. patent application Ser. No. 08/924,935, filed Sep. 8, 1997, pending.

BACKGROUND OF THE INVENTION

1. Field of the Invention

The present invention relates generally to rotary bits for drilling subterranean formations. More specifically, the invention relates not only to fixed cutter or so-called "drag" bits suitable for directional drilling, wherein tandem gage pads are employed to provide enhanced stability of the bit while drilling both linear and non-linear borehole segments, but also to rolling cutter or so-called "rock" bits employing a set of supplementary gage pads, or two sets in tandem. Leading surfaces of the gage pads and optionally trailing surfaces thereof are provided with discrete cutters or other cutting structures to remove ledging on the borehole sidewall and to provide a borehole conditioning gage and (in the case of trailing surface cutting structures) an up-drill capability.

2. State of the Art

It has long been known to design the path of a subterranean borehole to be other than linear in one or more segments, and so-called "directional" drilling has been practiced for many decades. Variations of directional drilling include drilling of a horizontal or highly deviated borehole from a primary, substantially vertical borehole and drilling of a borehole so as to extend along the plane of a hydrocarbon-producing formation for an extended interval, rather than merely transversely penetrating its relatively small width or depth. Directional drilling, that is to say, varying the path of a borehole from a first direction to a second, may be carried out along a relatively small radius of curvature as short as five to six meters, or over a radius of curvature of many hundreds of meters.

Perhaps the most sophisticated evolution of directional drilling is the practice of so-called navigational or steerable drilling, wherein a drill bit is literally steered to drill one or more linear and non-linear borehole segments as it progresses using the same bottomhole assembly and without tripping the drill string.

Positive displacement (Moineau) type motors as well as turbines have been employed in combination with deflection devices such as bent housings, bent subs, eccentric stabilizers, and combinations thereof to effect oriented, nonlinear drilling when the bit is rotated only by the motor drive shaft, and linear drilling when the bit is rotated by the superimposed rotation of the motor shaft and the drill string.

Other steerable bottomhole assemblies are known, including those wherein deflection or orientation of the drill string may be altered by selective lateral extension and retraction of one or more contact pads or members against the borehole wall. One such system is the AutoTrak™ drilling system, developed by the INTEQ operating unit of Baker Hughes Incorporated, assignee of the present invention. The bottomhole assembly of the AutoTrak™ drilling system employs a non-rotating sleeve through which a rotating drive shaft extends to drive a rotary bit, the sleeve thus being decoupled from drill string rotation. The sleeve carries individually controllable, expandable, circumferentially spaced steering ribs on its exterior, the lateral forces exerted by the ribs on the sleeve being controlled by pistons operated by hydraulic fluid contained within a reservoir located within the sleeve. Closed loop electronics measure the relative position of the sleeve and substantially continuously adjust the position of each steering rib so as to provide a steady side force at the bit in a desired direction.

In any case, those skilled in the art have designed rotary bits, and specifically rotary drag or fixed cutter bits, to facilitate and enhance "steerable" characteristics of bits, as opposed to conventional bit designs wherein departure from a straight, intended path, commonly termed "walk", is to be avoided. Examples of steerable bit designs are disclosed and claimed in U.S. Pat. No. 5,004,057 to Tibbitts, assigned to the assignee of the present invention.

Prevailing opinion for an extended period of time has been that bits employing relatively short gages, in some instances, even shorter than gage lengths for conventional bits not intended for steerable applications, facilitate directional drilling. The inventors herein have recently determined that such an approach is erroneous, and that short-gage bits also produce an increased amount of borehole irregularities, such as sidewall ledging, spiraling of the borehole, and rifling of the borehole sidewall. Excessive side cutting tendencies of a bit may lead to ledging of a severity such that downhole tools may actually become stuck when traveling through the borehole.

Elongated gage pads exhibiting little or no side cutting aggressiveness, or the tendency to engage and cut the formation, may be beneficial for directional or steerable bits, since they would tend to prevent sudden, large, lateral displacements of the bit, which displacements may result in the aforementioned so-called "ledging" of the borehole wall. However, a simplistic, elongated gage pad design approach exhibits shortcomings, as continuous, elongated gage pads extending down the side of the bit body may result in the trapping of formation cuttings in the elongated junk slots defined at the gage of the bit between adjacent gage pads, particularly if a given junk slot is provided with less than optimum hydraulic flow from its associated fluid passage on the face of the bit. Such clogging of only a single junk slot of a bit has been demonstrated to cause premature bit balling in soft, plastic formations. Moreover, providing lateral stabilization for the bit only at the circumferentially-spaced locations of gage pads comprising extensions of blades on the bit face may not be satisfactory in all circumstances. Finally, enhanced stabilization using elongated gage pads may not necessarily preclude all ledging of the borehole sidewall.

Moreover, it has been recognized by the inventors herein that so-called "rock" bits employing one or more rolling cutting structures, and those in particular employed in steerable applications, may also drill a borehole of substandard quality presenting ledges, steps and other undesirable borehole wall irregularities.

Thus, there is a need for both drag bits and rock bits which provide good directional stability as well as steerability, preclude lateral bit displacement, enhance formation cuttings removal from the bit, and maintain borehole quality.

BRIEF SUMMARY OF THE INVENTION

The present invention comprises a rotary drag bit, preferably equipped with polycrystalline diamond compact (PDC) cutters on blades extending above and radially to the side beyond the bit face, wherein the bit includes tandem, non-aggressive gage pads in the form of primary or longitudinally leading gage pads which may be substantially contiguous with the blades, and secondary or longitudinally trailing gage pads which are at least either longitudinally or rotationally discontinuous with the primary gage pads. Such an arrangement reduces any tendency toward undesirable side cutting by the bit, reducing ledging of the borehole sidewall.

The discontinuous tandem gage pads of the present invention not only provide the aforementioned benefits associated with conventional elongated gage pads, but provide a gap or aperture between circumferentially adjacent junk slots in the case of longitudinally discontinuous pads so that hydraulic flow may be shared between laterally-adjacent junk slots.

In the case of rotationally-offset, secondary gage pads, there is provided a set of rotationally-offset secondary junk slots above (as the bit is oriented during drilling) the primary junk slots, each of which secondary junk slots communicates with two circumferentially adjacent primary junk slots extending from the bit face, the hydraulic and cuttings flow from each primary junk slot being divided between two secondary junk slots. Thus, a relatively low-flow junk slot is not completely isolated, and excess or greater flows in its two laterally-adjacent junk slots may be contributed in a balancing effect, thus alleviating a tendency toward clogging of any particular junk slot.

In yet another aspect of the invention, the use of circumferentially-spaced, secondary gage pads rotationally offset from the primary gage pads provides superior bit stabilization by providing lateral support for the bit at twice as many circumferential locations as if only elongated primary gage pads or circumferentially-aligned primary and secondary gage pads were employed. Thus, bit stability is enhanced during both linear and non-linear drilling, and any tendency toward undesirable side cutting by the bit is reduced. Moreover, each primary junk slot communicates with two secondary junk slots, promoting fluid flow away from the bit face and reducing any clogging tendency.

In still another aspect of the invention, the secondary gage pads employed in the inventive bit are equipped with cutters on their longitudinally leading edges or surfaces at locations extending radially outwardly only substantially to the radially outer bearing surfaces of the secondary gage pads. Such cutters may also lie longitudinally above the leading edges or surfaces of a pad, but again do not extend beyond the radially outer bearing surface. Such cutters may comprise natural diamonds, thermally stable PDCs, or conventional PDCs comprised of a diamond table supported on a tungsten carbide substrate. The presence of the secondary gage pad cutters provides a reaming capability to the bit so that borehole sidewall irregularities created as the bit drills ahead are smoothed by the passage of the secondary gage pads. Thus, any minor ledging created as a result of bit lateral vibrations or by frequent flexing of the bottomhole assembly driving the bit due to inconsistent application of weight on bit can be removed, improving borehole quality.

In one embodiment of the invention, the cutters comprise PDC cutters having a diamond table supported on a tungsten carbide or other substrate as known in the art, wherein the longitudinal axes of the cutters are oriented substantially transverse to the orientation of the longitudinally leading surface or edge of at least some, and preferably all, of the secondary gage pads. The diamond tables of such cutters may be provided with an annular chamfer at least facing in the direction of bit rotation, or a flat or linear chamfer on that side of the diamond table. Ideally, the chamfer is shaped and oriented to present a relatively aggressive cutting edge at the periphery of a cutting surface comprising a robust mass of diamond material exhibiting a negative rake angle to the formation in the direction of the shallow helical path traversed by the cutter so as to eliminate the aforementioned ledging. The cutters may optionally be slightly tilted backward, relative to the direction of bit rotation, to provide a clearance angle behind the cutting edge.

In another embodiment of the invention, an insert having a chisel-shaped diamond cutting surface having an apex flanked by two side surfaces and carried on a tungsten carbide or other stud, such as is employed in rock bits, may be mounted to the leading surface or edge of the secondary gage pads. The diamond cutting surface may comprise a PDC. As used previously herein, the term "cutters" includes such inserts mounted to secondary gage pads. The insert may be oriented substantially transverse to the orientation of the longitudinally leading surface or edge, or tilted forward, relative to the direction of rotation, so as to present the apex of the chisel to a formation ledge or other irregularity on the borehole wall with one side surface substantially parallel to the longitudinally leading surface and the other side surface substantially transverse thereto, and generally in line with the rotationally leading surface of the gage pad to which the insert is mounted.

Depending on the formation hardness and abrasiveness, tungsten carbide cutters or diamond film or thin PDC layer-coated tungsten carbide cutters or inserts exhibiting the aforementioned physical configuration and orientation may be employed in lieu of PDC cutters or inserts employing a relatively large thickness or depth of diamond. In any case, as previously described, the secondary gage pad leading surface cutters do not extend beyond the radially outward bearing surfaces of the secondary gage pads, and so are employed to smooth and refine the wall of the borehole by removing steps and ledges.

Yet another embodiment of the invention may involve the disposition of cutting structures in the form of coarse tungsten carbide granules or grit on the leading surfaces or edges of the secondary gage pads, such grit being brazed or otherwise bonded to the pad surface. A macrocrystalline tungsten carbide material, sometimes employed as hardfacing material on drill bit exteriors, may also be employed for suitable formations.

Yet another aspect of the invention involves the use of cutting structures on the trailing edges of the secondary gage pads to provide drill bits so equipped with an up-drill capability to remove ledges and other irregularities encountered when tripping the bit out of the borehole. As with the embodiment of leading surface cutters described immediately above, cutters (or inserts) having a defined cutting edge may be employed, including the abovementioned PDC cutters, tungsten carbide cutters and diamond-coated tungsten carbide cutters, or, alternatively, tungsten carbide granules or macrocrystalline tungsten carbide may be bonded to the longitudinally trailing gage pad surface.

In a rock bit embodiment of the invention, a plurality of supplementary gage pads at the same or higher elevation as (as the bit is oriented during drilling) the primary cutting structure of the bit (i.e., the rolling cones) provides similar advantages as previously described above with respect to rock bits. If desired, two groups of at least partially longitudinally-separated gage pads may be employed in a "tandem" arrangement, again as described above with respect to drag bits. One group, comprising the "primary" pads, may be located on the radial exterior of the bit legs carrying the cones, or be located thereabove on the bit body and between the legs. Similarly, if the primary pads are located on the legs, the "secondary" or longitudinally trailing pads may be located between and above the legs. If the primary pads are themselves located above the legs, the secondary pads are preferably respectively farther above the primary pads. As in the case of gage pads employed on the drag bit embodiments, cutting structures of various types may be employed on the longitudinally leading and, optionally, trailing surfaces thereof to condition the borehole wall. The radial exteriors of the gage pads are again "slick" and laterally nonaggressive, as with the drag bit embodiments of the invention. The increased gage contact area provided by the gage pads according to the present invention is also believed to provide an added benefit by sharing the laterally inward thrust loads on the rolling cones and bearing structures to which the cones are mounted, potentially extending the lives of the bearings and associated seals.

Using the tandem gage according to the present invention, a better quality borehole and borehole wall surface in terms of roundness, longitudinal continuity and smoothness is created. Such borehole conditions allow for smoother transfer of weight from the surface of the earth through the drill string to the bit, as well as better tool face control, which is critical for monitoring and following a design borehole path by the actual borehole as drilled. Use of cutters on trailing surfaces of the secondary gage pads in addition to furnishing the leading surfaces thereof with cutters facilitates removal of the bit from the borehole and further provides back reaming capabilities to ensure a better quality borehole and borehole wall surface.

DETAILED DESCRIPTION OF THE INVENTION

Figure 1:
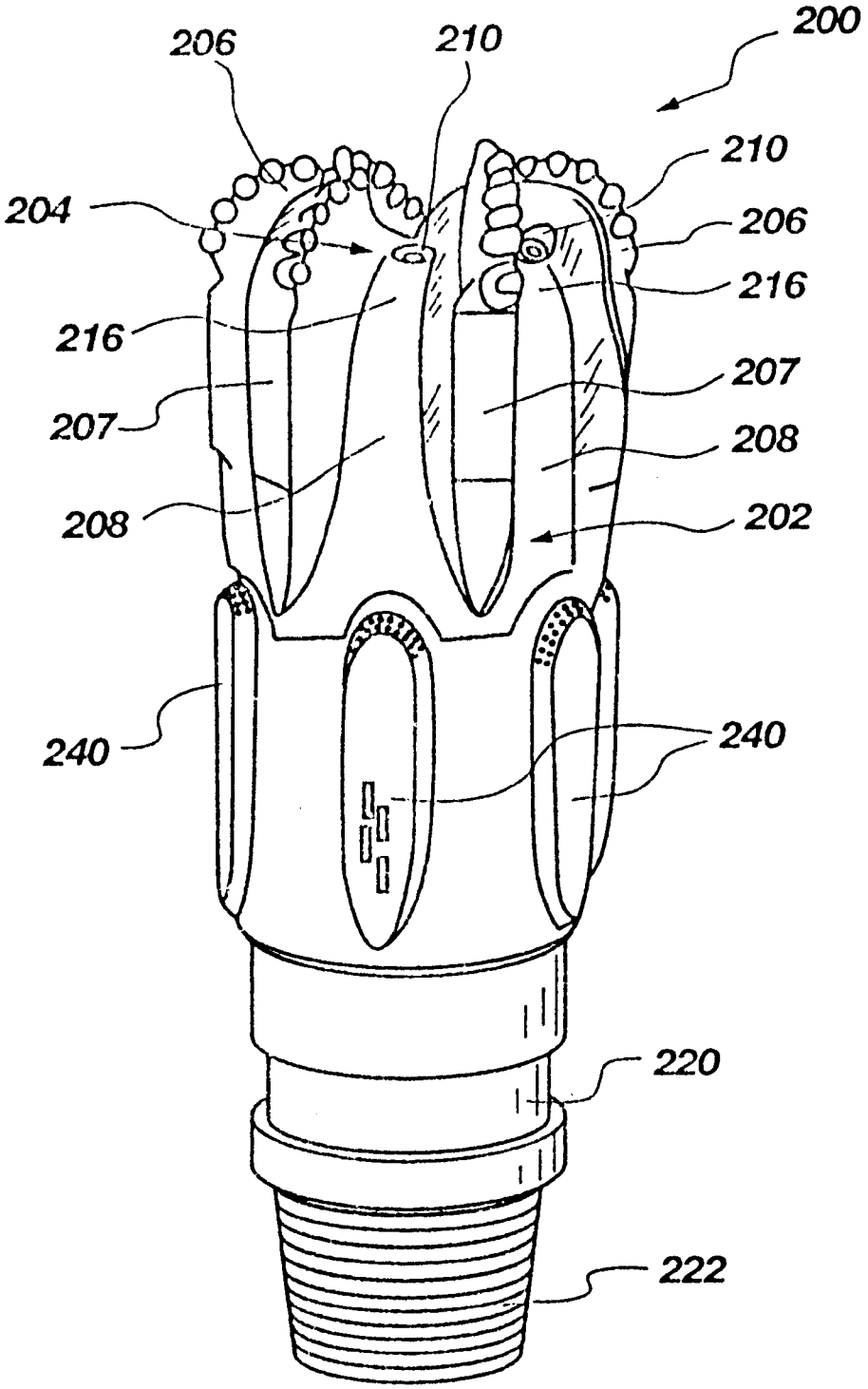
FIG. 1 comprises a side perspective view of a PDC-equipped rotary drag bit according to the present invention.

FIGS. 1 through 5 depict an exemplary rotary drag bit 200 according to the invention. Bit 200 includes a body 202 having a face 204 and including a plurality (in this instance, six) of generally radially oriented blades 206 extending above the bit face 204 to primary gage pads 207. Primary junk slots 208 lie between longitudinal extensions of adjacent blades 206, which comprise primary gage pads 207 in this embodiment. A plurality of nozzles 210 provides drilling fluid from plenum 212 within the bit body 202 and the drilling fluid is conducted through passages 214 to the bit face 204. Formation cuttings generated during a drilling operation are transported across bit face 204 through fluid courses 216 communicating with respective primary junk slots 208. Secondary gage pads 240 are rotationally and substantially longitudinally offset from primary gage pads 207, and provide additional stability for bit 200 when drilling both linear and non-linear borehole segments. Shank 220 includes a threaded pin connection 222, as known in the art, although other connection types may be employed.

Figure 4:
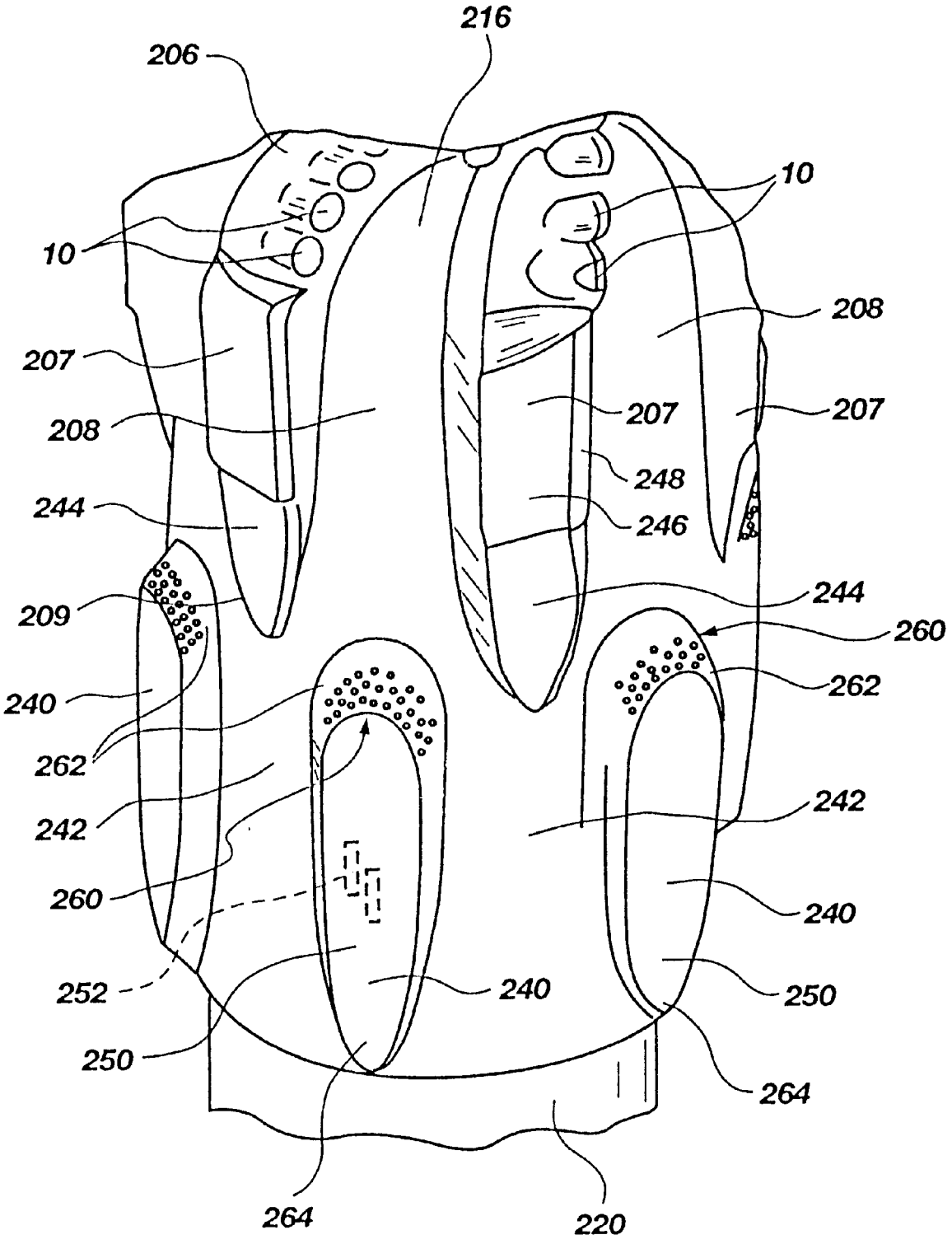
FIG. 4 is an enlarged perspective view of the side of the bit of FIG. 1, showing the configurations and relative locations and orientations of tandem primary gage pads (blade extensions) and secondary gage pads according to the invention.

Primary gage pads 207 define primary junk slots 208 therebetween, while secondary gage pads 240 define secondary junk slots 242 therebetween, each primary junk slot 208 feeding two secondary junk slots 242 with formation cuttings-laden drilling fluid received from fluid courses 216 on the bit face 204. As shown, the trailing, radially outer surfaces 244 of primary gage pads 207 are scalloped or recessed to some extent, the major, radially outer bearing surfaces 246 of the primary gage pads 207 are devoid of exposed cutters and the rotationally leading edges 248 thereof are rounded or smoothed to substantially eliminate any side cutting tendencies above (in normal drilling orientation) radially outermost small chamfer cutters 10 on blades 206. Similarly, the radially outer bearing surfaces 250 of secondary gage pads 240 are devoid of exposed cutters, and (as with radially outer bearing surfaces 246 of primary gage pads 207) preferably comprise wear-resistant surfaces such as tungsten carbide, diamond grit-filled tungsten carbide, a ceramic, or other abrasion-resistant material as known in the art. The outer bearing surfaces 250 and 246 may also comprise discs, bricks or other inserts of wear-resistant material (see 252 in FIG. 4) bonded to the outer surface of the pads, or bonded into a surrounding powdered WC matrix material with a solidified liquid metal binder, as known in the art. The outer bearing surfaces 246, 250 of respective primary and secondary gage pads 207 and 240 may be rounded at a radius of curvature, taken from the centerline or longitudinal axis of the bit, substantially the same as (slightly smaller than) the gage diameter of the bit, if desired. Further, the secondary gage pads 240 may be sized to define a smaller diameter than the primary gage pads 207, and measurably smaller than the nominal or gage diameter of the bit 200. As shown in FIGS. 1 and 4, there may be a slight longitudinal overlap between primary gage pads 207 and secondary gage pads 240, although this is not required (see FIG. 6) and the tandem gage pads 207, 240 may be entirely longitudinally discontinuous. It is preferable that the trailing ends 209 of primary gage pads 207 be tapered or streamlined as shown, in order to enhance fluid flow therepast and eliminate areas where hydraulic flow and entrained formation cuttings may stagnate. It is also preferable that secondary gage pads 240 (as shown) be at least somewhat streamlined at both leading edges or surfaces 262 and at their trailing ends 264 for enhancement of fluid flow therepast.

Secondary gage pads 240 carry cutters 260 on their longitudinally leading edges, which in the embodiment illustrated in FIGS. 1 through 4 comprise arcuate surfaces 262. As shown, cutters 260 comprise exposed, three-per-carat natural diamonds, although thermally stable PDCs may also be employed in the same manner. The distribution of cutters 260 over arcuate leading surfaces 262 provides both a longitudinal and rotational cutting capability for reaming the sidewall of the borehole after passage of the bit blades 206 and primary gage pads 207 to substantially remove any irregularities in and on the sidewall, such as the aforementioned ledges. Thus, the bottomhole assembly following bit 200 is presented with a smoother, more regular borehole configuration.

Figure 6:
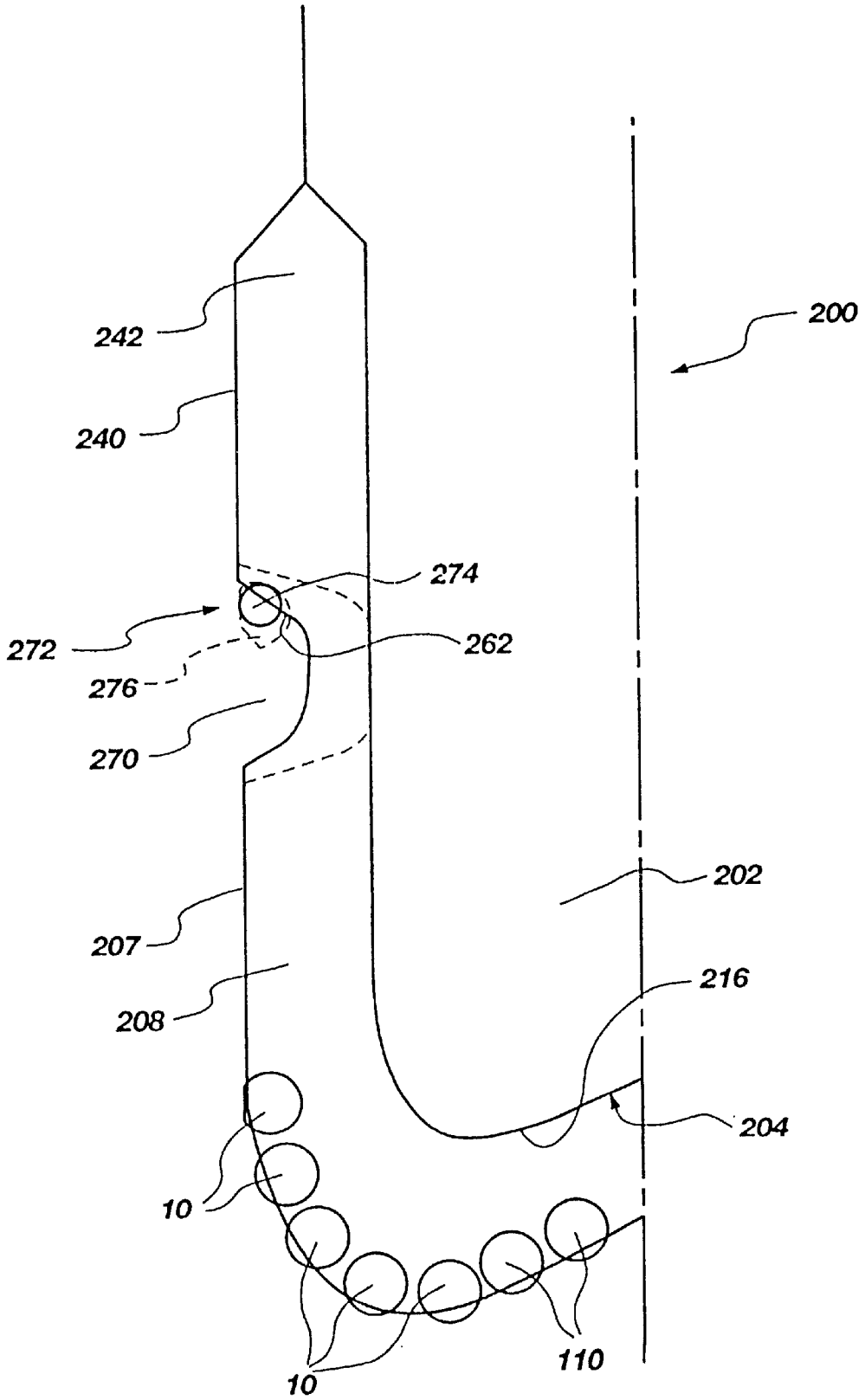
FIG. 6 is a schematic side view of a longitudinally-discontinuous tandem gage pad arrangement according to the invention, depicting the use of PDC cutters on the secondary gage pad leading edge.

As shown in FIG. 6, the bit 200 of the present invention may alternatively comprise circumferentially aligned but longitudinally discontinuous gage pads 207 and 240, with a notch or bottleneck 270 located therebetween. In such a configuration, primary junk slots 208 are rotationally aligned with secondary junk slots 242, and mutual fluid communication between laterally adjacent junk slots (and indeed, about the entire lateral periphery or circumference of bit 200) is through notches or bottlenecks 270. The radial recess depth of notches or bottlenecks 270 may be less than the radial height of the gage pads 207 and 240, or may extend to the bottoms of the junk slots defined between the gage pads, as shown in broken lines. In FIG. 6, the cutters employed on the leading surface 262 of secondary gage pad 240 comprise PDC cutters 272, which may exhibit disc-shaped cutting faces 274, or may be configured with flat or linear cutting edges as shown in broken lines 276. It should also be understood that more than one type of cutter 260 may be employed on a secondary gage pad 240, and that different types of cutters 260 may be employed on different secondary gage pads 240.

Figure 5:
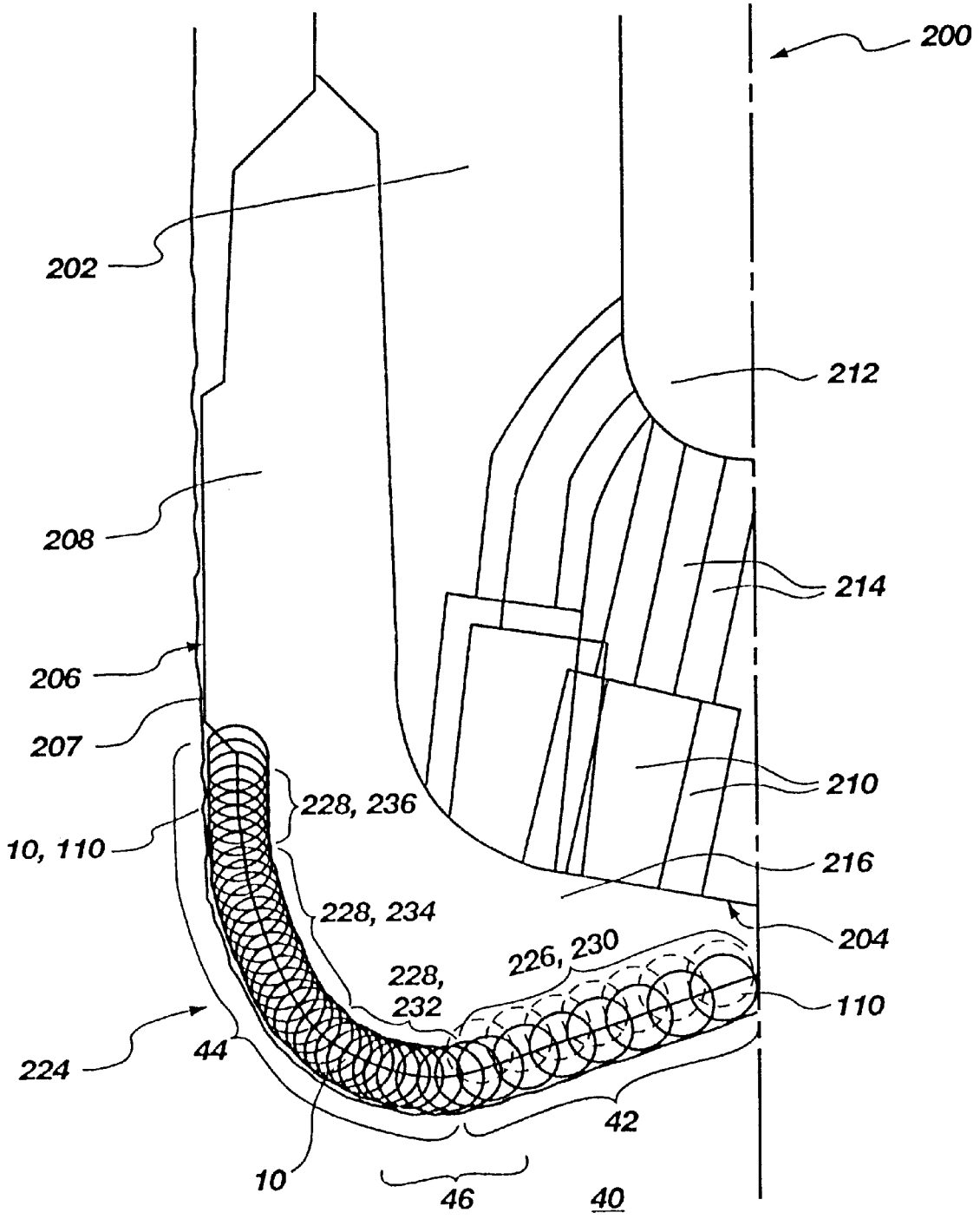
FIG. 5 comprises a quarter-sectional side schematic of a bit having a profile such as that of FIG. 1, with the cutter locations rotated to a single radius extending from the bit centerline to the gage to disclose various cutter chamfer sizes and angles, and cutter backrake angles, which may be employed with the inventive bit.

To complete the description of the bit of FIGS. 1 through 5, although the specific structure is not required to be employed as part of the invention herein, the profile 224 of the bit face 204 as defined by blades 206 is illustrated in FIG. 5, wherein bit 200 is shown adjacent a subterranean rock formation 40 at the bottom of the well bore. Bit 200 is, as disclosed, believed to be particularly suitable for directional drilling, wherein both linear and non-linear borehole segments are drilled by the same bit. First region 226 and second region 228 on profile 224 face adjacent rock zones 42 and 44 of formation 40 and respectively carry large chamfer cutters 110 and small chamfer cutters 10. First region 226 may be said to comprise the cone 230 of the bit profile 224 as illustrated, whereas second region 228 may be said to comprise the nose 232 and flank 234 and extend to shoulder 236 of profile 224, terminating at primary gage pad 207.

In a currently preferred embodiment of the invention, large chamfer cutters 110 may comprise cutters having PDC tables in excess of 0.070 inch thickness, and preferably about 0.080 to 0.090 inch depth, with chamfers 124 of about a 0.030 to 0.060 inch width, looking at and perpendicular to the cutting face, and oriented at a 45° angle to the cutter axis. The cutters themselves, as disposed in region 226, are backraked at 20° to the bit profile at each respective cutter location, thus providing chamfers 124 with a 65° back/rake. Small chamfer cutters 10, on the other hand, disposed in region 228, may comprise conventionally-chamfered cutters having about a 0.030 inch PDC table thickness, and a 0.010 inch chamfer width looking at and perpendicular to the cutting face, with chamfers 24 oriented at a 45° angle to the cutter axis. Small chamfer cutters 10 are themselves backraked at 15° on nose 232 (providing a 600 chamfer backrake), while cutter backrake is further reduced to 10° at the flank 234, shoulder 236 and adjacent the primary gage pads 207 of bit 200 (resulting in a 550 chamfer backrake). The small chamfer cutters 10 adjacent primary gage pads 207 include preformed flats thereon oriented parallel to the longitudinal axis of the bit 200, as known in the art. In steerable applications requiring greater durability at the shoulder 236, large chamfer cutters 110 may optionally be employed, but oriented at a 10° cutter backrake. Further, the chamfer angle of large chamfer cutters 110 in each of region 226 and shoulder 236 may be other than 45°. For example, 70° chamfer angles may be employed with chamfer widths (looking vertically at the cutting face of the cutter) in the range of about 0.035 to 0.045 inch, large chamfer cutters 110 being disposed at appropriate backrakes to achieve the desired chamfer rake angles in the respective regions.

A boundary region, rather than a sharp boundary, may exist between first and second regions 226 and 228. For example, rock zone 46 bridging the adjacent edges of rock zones 42 and 44 of formation 40 may comprise an area wherein demands on cutters and the strength of the formation are always in transition due to bit dynamics. Alternatively, the rock zone 46 may initiate the presence of a third region on the bit profile wherein a third size of cutter chamfer is desirable. In any case, the annular area of profile 224 opposing zone 46 may be populated with cutters of both types (i.e., width and chamfer angle) and employing backrakes respectively employed in region 226 and those of region 228, or cutters with chamfer sizes, angles and cutter backrakes intermediate those of the cutters in regions 226 and 228 may be employed.

Further, it will be understood and appreciated by those of ordinary skill in the art that the tandem gage pad configuration of the invention has utility in conventional bits as well as for bits designed specifically for steerability, and is therefore not so limited.

In the rotationally-offset secondary gage pad variation of the invention, it is further believed that the additional contact points afforded between the bit and the formation may reduce the tendency of a bit to incur damage under "whirl", or backward precession about the borehole, such phenomenon being well known in the art. By providing additional, more closely circumferentially-spaced points of lateral contact between the bit and the borehole sidewall, the distance a bit may travel laterally before making contact with the sidewall is reduced, in turn reducing severity of any impact.

Referring now to FIGS. 7 and 8A–C of the drawings, yet another embodiment 200*a* of the bit 200 of the present invention will be described. Reference numerals previously employed will be used to identify the same elements. Bit 200*a* includes a body 202 having a face 204 and including a plurality (again, six) of generally radially oriented blades 206 extending above the bit face 204 to primary gage pads 207. Primary junk slots 208 lie between longitudinal extensions of adjacent blades 206, which comprise primary gage pads 207. A plurality of nozzles 210 provides drilling fluid from a plenum within the bit body 202 and the drilling fluid is conducted through passages to the bit face 204, as previously described with reference to FIG. 5. Formation cuttings generated during a drilling operation are transported across bit face 204 through fluid courses 216 communicating with respective primary junk slots 208. Secondary gage pads 240 are rotationally and completely longitudinally offset from primary gage pads 207, and provide additional stability for bit 200*a* when drilling both linear and non-linear borehole segments. Shank 220 includes a threaded pin connection 222 as known in the art, although other connection types may be employed.

Figure 7:
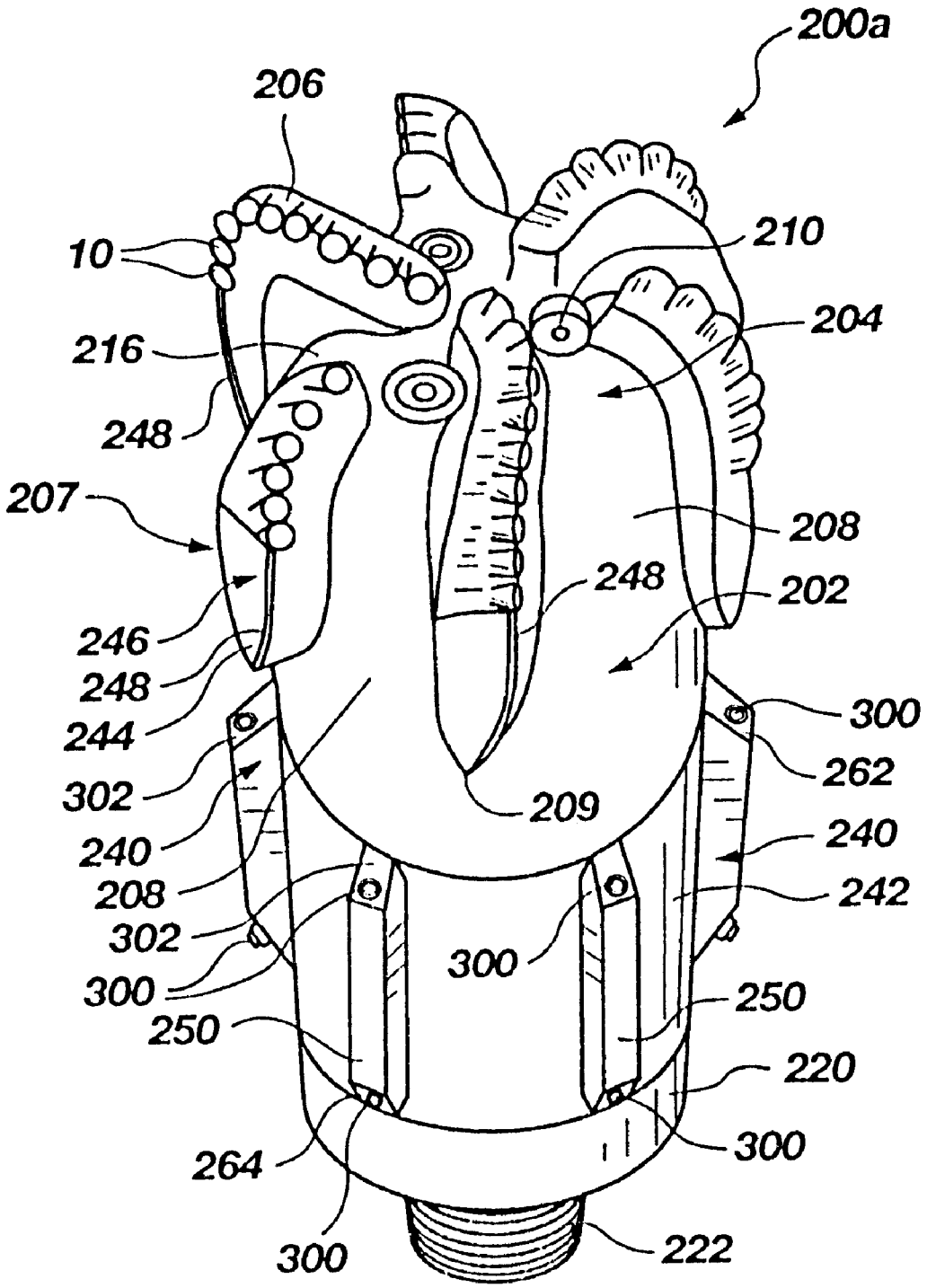
FIG. 7 is a side perspective view of a second PDC-equipped rotary drag bit according to the present invention employing discrete cutters on the leading and trailing surfaces of the secondary gage pads.

Primary gage pads 207 define primary junk slots 208 therebetween, while secondary gage pads 240 define secondary junk slots 242 therebetween, each primary junk slot 208 feeding two secondary junk slots 242 with formation cuttings-laden drilling fluid received from fluid courses 216 on the bit face. As shown, and unlike the embodiment of FIGS. 1–5, the trailing, radially outer surfaces 244 of primary gage pads 207 are not scalloped or recessed to any measurable extent and include the major, radially outer bearing surfaces 246 of the primary gage pads 207. Bearing surfaces 246 are devoid of exposed cutters and the rotationally leading edges 248 thereof are rounded or smoothed to substantially eliminate any side cutting tendencies above (in normal drilling orientation) radially outermost small chamfer cutters 10 on blades 206 and to compact filter cake on the borehole wall rather than scraping and damaging it. Further, the smooth leading edges reduce any tendency of the bit to "whirl", or precess in a backward direction of rotation, since aggressive leading edges may induce such behavior. Similarly, the radially outer bearing surfaces 250 of secondary gage pads 240 are devoid of exposed cutters, and (as with radially outer bearing surfaces 246 of primary gage pads 207) preferably comprise wear-resistant surfaces such as tungsten carbide, diamond grit-filled tungsten carbide, a ceramic, or other abrasion-resistant material as known in the art. The outer bearing surfaces 250 and 246 may also comprise discs, bricks or other inserts of wear-resistant material (see 252 in FIG. 4) bonded to the outer surface of the pads, or bonded into a surrounding powdered WC matrix material with a solidified liquid metal binder, as known in the art. The outer bearing surfaces 246 and 250 may also comprise a tungsten carbide hardfacing material such as is disclosed in U.S. Pat. No. 5,663,512, assigned to the assignee of the present invention and hereby incorporated herein by this reference, or other, conventional, tungsten carbide-containing hardfacing materials known in the art. The outer bearing surfaces 246, 250 of respective primary and secondary gage pads 207 and 240 may be rounded at a radius of curvature, taken from the centerline or longitudinal axis of the bit, substantially the same as (slightly smaller than) the gage diameter of the bit, if desired. Further, the secondary gage pads 240 may be sized to define a smaller diameter than the primary gage pads 207, and measurably smaller than the nominal or gage diameter of the bit 200. As shown in FIG. 7, there is no longitudinal overlap between primary gage pads 207 and secondary gage pads 240, the two sets of gage pads being entirely longitudinally discontinuous. It is preferable that the trailing ends 209 of primary gage pads 207 be tapered or streamlined as shown, in order to enhance fluid flow therepast and eliminate areas where hydraulic flow and entrained formation cuttings may stagnate. It is also preferable that secondary gage pads 240 (as shown) be at least somewhat streamlined at both leading edges or surfaces 262 and at their trailing ends 264 for enhancement of fluid flow therepast.

Figure 8A:
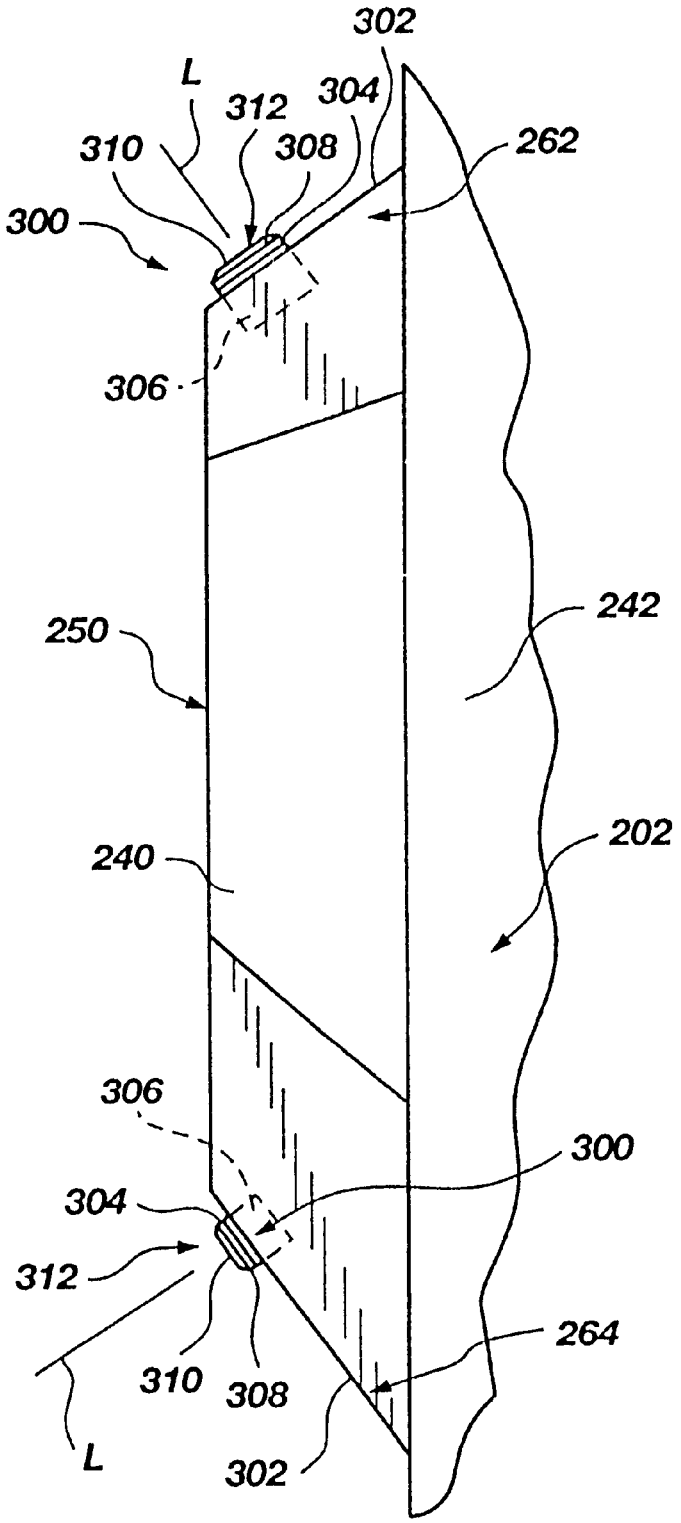
FIG. 8A is an enlarged side view of a secondary gage pad of the bit of FIG. 7 carrying a cutter on a leading and a trailing surface thereof.
Figure 8B:
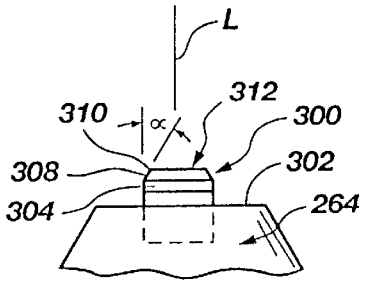
FIG. 8B is a longitudinal frontal view of the leading surface and cutter mounted thereon of the secondary gage pad of FIG. 8A looking parallel to the surface.

Secondary gage pads 240 carry cutters 300 on their longitudinally leading ends, which in the embodiment illustrated in FIGS. 7 and 8A–C comprise leading surfaces 262 including cutter flats 302. As best shown in FIG. 8A, cutters 300 comprise PDC cutters comprising diamond tables 304 bonded to substantially cylindrical cemented tungsten carbide substrates 306. Cutters 300 are oriented with their longitudinal axes L substantially perpendicular to cutter flats 302 and disposed in a radial direction with respect to the longitudinal axis of bit 200*a*, so that arcuate, preferably annular, chamfers or rake lands 308 at the periphery of the diamond tables 304 (see FIG. 8B) present superabrasive cutting surfaces oriented at a negative rake angle $\alpha$ to a line perpendicular to the formation as the bit rotates and moves longitudinally ahead during a drilling operation and cutters 300 traverse a shallow helical path. Thus, the distribution of cutters 300 on cutter flats 302 provides a relatively aggressive, controlled cutting capability for reaming the sidewall of the borehole after passage of the bit blades 206 and primary gage pads 207 to substantially remove any irregularities in and on the sidewall, such as the aforementioned ledges. The use of cutters 300 configured as described is believed to provide a more efficient and aggressive cutting action for ledge removal than natural diamonds or thermally stable diamonds as previously described and illustrated in FIGS. 1, 2 and 4, and a more robust, fracture- and wear-resistant cutter than PDC cutters oriented with their longitudinal axes disposed generally in the direction of bit rotation, as depicted in FIG. 6. Thus, the bottomhole assembly following bit 200*a* may be presented with a smoother, more regular borehole configuration over a longer drilling interval.

In addition to the use of cutters 300 on leading surfaces 262 of secondary gage pads 240, the trailing ends or surfaces 264 of secondary gage pads 240 (see FIG. 8A) may also be provided with cutters 300 to provide an up-drill capability for removing borehole and borehole wall irregularities as bit 200*a* and its associated bottomhole assembly are tripped out of the borehole or alternately raised or lowered to condition the wall of the borehole. Trailing ends 264 may be provided with cutter flats 302 and cutters 300 of like configuration and orientation to cutters 300 used on leading surfaces 262 disposed thereon to provide the aforementioned longitudinal and rotational cutting capability. The cutters 300 used on trailing ends 264 may be of the same, smaller or larger diameter than those used on the leading ends 262 of the secondary gage pads 240.

It is preferred that the cutters 300 exhibit a relatively thick diamond table, on the order of 0.050 inch or more, although diamond table thicknesses of as little as about 0.020 inch are believed to have utility in the present invention. It is preferred that a significant, or measurable, chamfer or rake land 308, on the order of about 0.020 to 0.100 inch depth be employed. The chamfer may be oriented at an angle of about 30° to about 60°, for example at about 45°, to the longitudinal axis of the cutter 300, so as to provide a substantial negative backrake to the surface of chamfer 308 adjacent the cutting edge 310, which, due to this orientation of the cutter 300, lies between the chamfer or rake land 308 and the central portion or clearance face 312 of the face of the diamond table 304. Thus, a relatively aggressive cutting edge 310 is presented, but the negative backrake of chamfer or rake land 308 provides requisite durability.

Figure 8C:
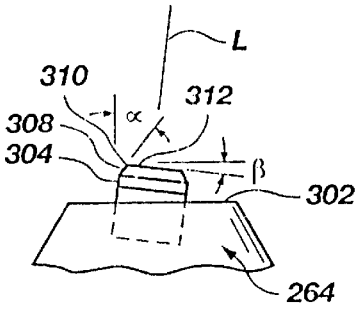
FIG. 8C is a frontal view of the leading surface of the secondary gage pad of FIG. 8A showing the same cutter thereon, but in a different orientation.

Referring now to FIG. 8C of the drawings, it is also possible to mount cutters 300 so as to lean "backward" relative to the direction of bit rotation and to a line perpendicular to the borehole sidewall so as to cause only the cutting edge 310 at the inner periphery of chamfer 308 to substantially engage the formation, the central portion or clearance face 312 of the diamond table 304 being thus tilted at a small angle $\beta$, such as about 5°, away from an orientation parallel to cutter flat 302 and hence away from the borehole wall. Thus, central portion or clearance face 312 is maintained substantially free of engagement with the formation material comprising ledges and other irregularities on the borehole wall so as to reduce friction and wear of the diamond table 304, as well as consequent heating and potential degradation of the diamond material. In this variation, backrake angle $\alpha$ may be controlled by orientation of the cutter as well as by the chamfer angle. It will also be appreciated that a clearance angle may be provided with the cutter orientation depicted in FIGS. 8A and 8B by forming or working the central portion or clearance face 312 of cutter 300 so that it lies at an oblique angle with respect to the longitudinal axis of the cutter, rather than perpendicular thereto. While cutters 300 have been illustrated in FIGS. 8B and 8C as substantially centered on the surface of cutter flat 302, it will be appreciated that placement closer to a rotationally leading edge of the secondary gage pad may be preferred, in some instances, to reduce the potential for wear of the gage pad material as irregularities in the borehole wall are encountered.

Cutters having a relatively thick diamond table and large chamfers or rake lands, and variations thereof, are disclosed in U.S. Pat. No. 5,706,906, assigned to the assignee of the present invention, the disclosure of which is hereby incorporated herein by this reference. It is also contemplated that cutters of other designs exhibiting an annular chamfer, or a linear or flat chamfer, or a plurality of such flat chamfers, may be employed in lieu of cutters with annular chamfers. Such cutters are disclosed in U.S. Pat. Nos. 5,287,936, 5,346,026, 5,467,836 and 5,655,612, and copending U.S. application Ser. No. 08/815,063, each assigned to the assignee of the present invention, the disclosures of each being hereby incorporated herein by this reference. In addition, cutters employed on leading and trailing ends of the secondary gage pads may also comprise suitably shaped tungsten carbide studs or inserts, or such studs or inserts having a diamond coating over at least a portion of their exposed outer ends such as is known in the art. The significance in cutter selection lies in the ability of the selected cutter to efficiently and aggressively cut the formation while exhibiting durability required to survive drilling of the intended borehole interval without wear or degradation to an extent which significantly impairs the cutting action. The specific materials being employed in the cutters to engage the formation are dictated to a large extent by formation characteristics such as hardness and abrasiveness.

Figure 9A:
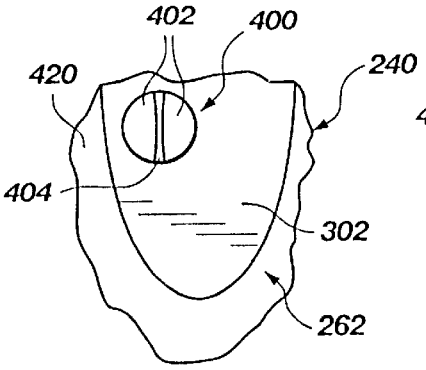
FIGS. 9A and 9B are, respectively, a top view of a chisel-shaped cutter mounted transversely to a cutter flat of a secondary gage pad leading surface, taken perpendicular to the cutter flat, and a longitudinal frontal view of the cutter so mounted, taken parallel to the cutter flat.
Figure 9B:
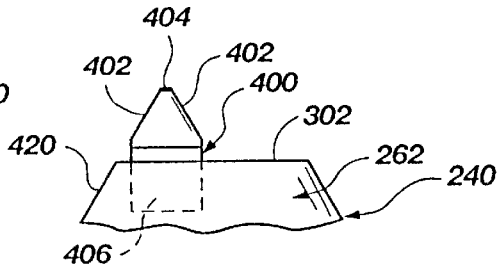
Figure 10A:
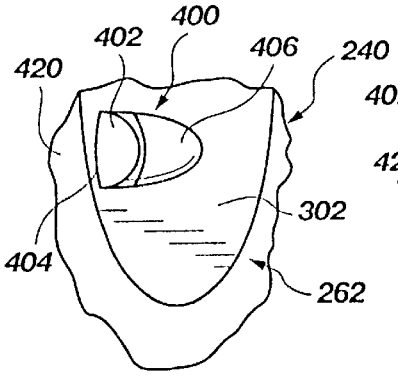
FIGS. 10A and 10B are, respectively, a top view of a chisel-shaped cutter mounted in a rotationally forward-leaning direction with respect to a cutter flat of a secondary gage pad leading surface, taken perpendicular to the cutter flat, and a longitudinal frontal view of the cutter so mounted, taken parallel to the cutter flat.
Figure 10B:
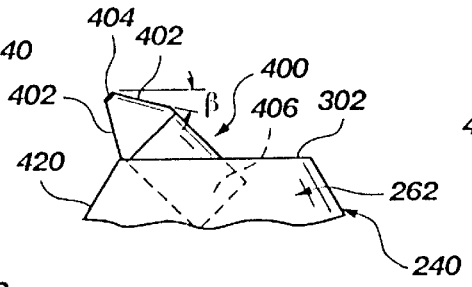

Referring now to drawing FIGS. 9A, 9B, 10A, 10B and 10C, a variation of the cutter configuration of FIGS. 7 and 8A–C for bit 200*a* is depicted. Cutters 400 may be substituted for cutters 300 previously disclosed herein on the leading surfaces 262 and/or the trailing surfaces 264 of secondary gage pads 240. Cutters 400 may be generally described as "chisel shaped", exhibiting a cutting end comprised of two side surfaces 402 converging toward an apex 404. The side surfaces and apex may comprise a substantial PDC mass formed onto a substantially cylindrical stud 406 of suitable substrate material such as cemented tungsten carbide, a diamond coating formed over a stud exhibiting a chisel shape, or even an uncoated cemented tungsten carbide stud, for softer formation use. As shown in FIGS. 9A and 9B, a cutter 400 may, by way of example only, be disposed adjacent a rotationally leading edge or surface 420 of a cutter flat 302 of a leading secondary gage pad surface 262 with its longitudinal axis substantially perpendicular to cutter flat 302. Alternatively, as shown in FIGS. 10A and 10B, cutter 400 may be disposed at a similar location on cutter flat 302 of leading surface 262 of a secondary gage pad 240 so as to lean "forward", toward the direction of bit rotation so that one of the side surfaces 402 is substantially parallel (but preferably tilted at a slight clearance angle $\beta$) with respect to a line perpendicular to cutter flat 302 and thus with respect to the borehole wall, while the other side surface 402 is substantially transverse to the borehole wall and generally in line with the rotationally leading side surface 420 of the gage pad 240 to which the cutter 400 is mounted. In the former orientation, cutter 400 operates to scrape the borehole wall surface while, in the latter orientation, apex 404 of cutter 400 functions as a true chisel apex to shear formation material. Of course, cutter 400 may also be mounted to a trailing surface 264 of a secondary gage pad 240 to provide an up-drill capability.

Figure 10C:
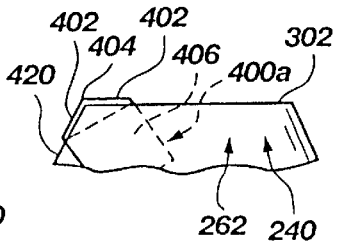
FIG. 10C is a longitudinal frontal view of a chisel-shaped cutter, taken parallel to the cutter flat, wherein the sides of the chisel meeting at the apex are separated by a larger angle than the cutter of FIGS. 10A and 10B so as to present a more blunt cutting structure substantially recessed into the gage pad surface.

As shown in FIG. 10C, a chisel-shaped cutter 400*a* may be comprised of side surfaces 402 meeting at apex 404 but defining a larger angle therebetween than the cutters 400 of FIGS. 9A, 9B, 10A and 10B. Cutter 400*a* may be configured so as to have one side surface 402 parallel to, and substantially coincident with, cutter flat 302 and the other side surface 402 parallel to, and substantially coincident with, rotationally leading side surface 420, cutter 400*a* being substantially recessed within secondary gage pad 240 and presenting minimal exposure therefrom. Of course, the cutter 400*a* may be configured or oriented to present a clearance angle with respect to formation material being cut, as has been described with respect to preceding embodiments. Additionally, the rotationally leading side surface 402 of cutter 400*a* presents a suitable negative backrake angle.

Figure 2:
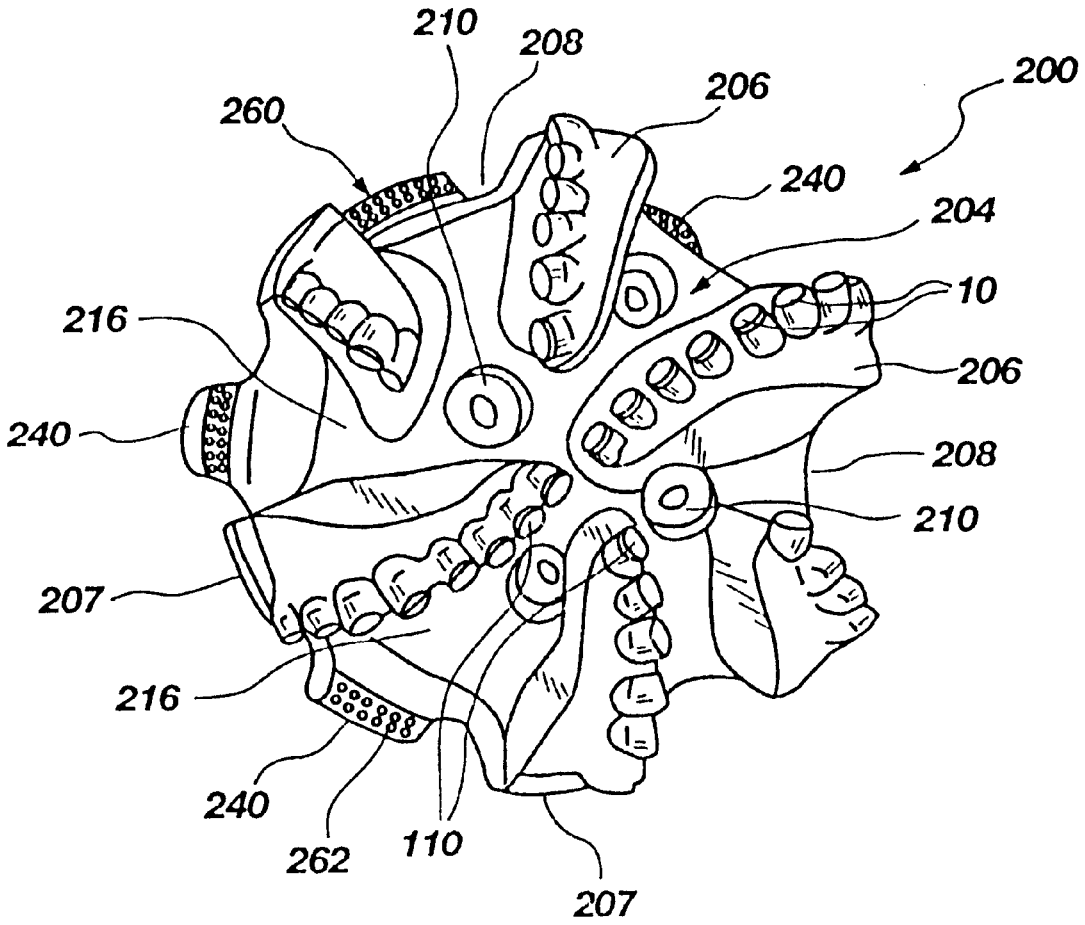
FIG. 2 comprises a face view of the bit of FIG. 1.
Figure 3:
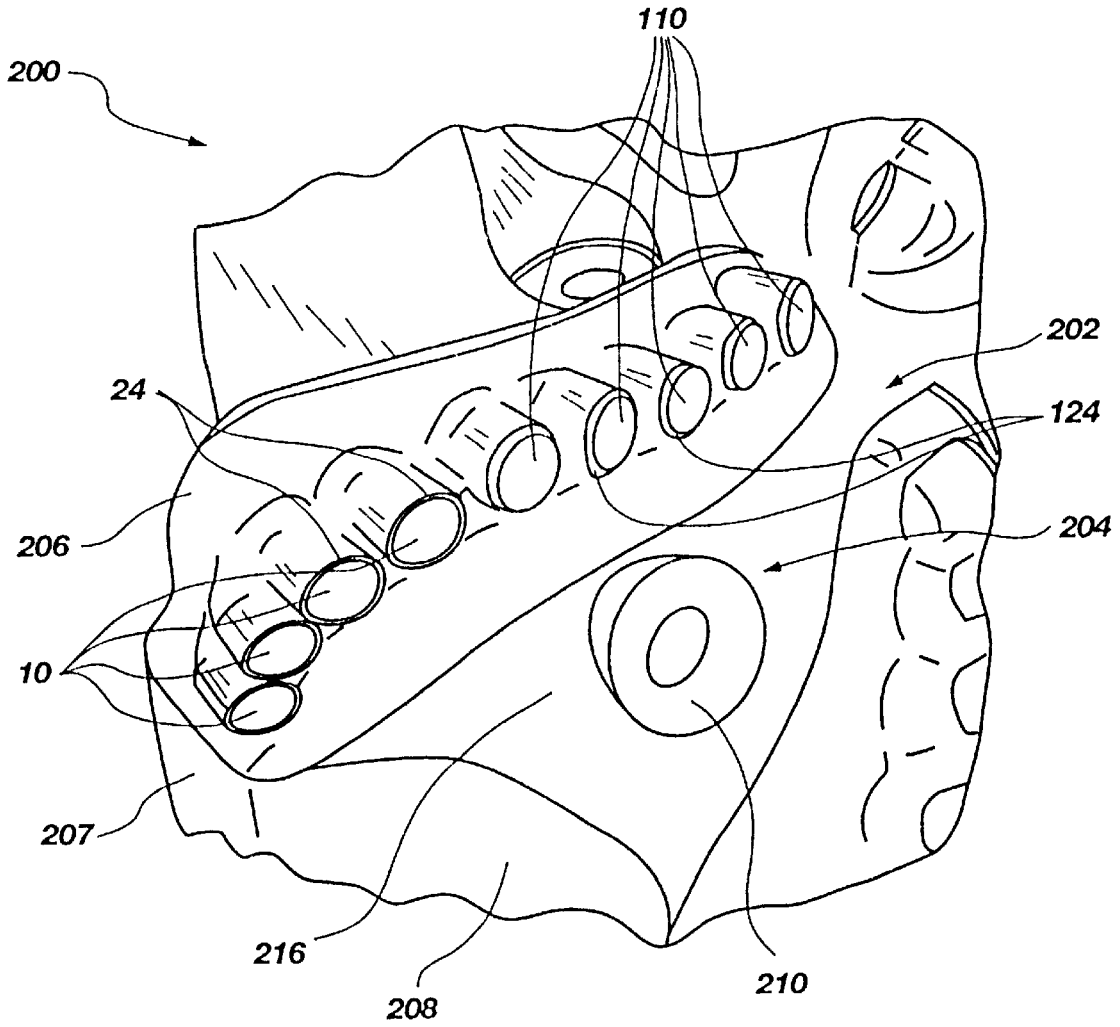
FIG. 3 comprises an enlarged, oblique face view of a single blade of the bit of FIG. 1.

In lieu of discrete cutters or inserts, or natural diamonds, as previously described, the leading surfaces 262 or trailing surfaces 264 of the secondary gage pads 240 may be equipped with cutting structures in the form of tungsten carbide granules brazed or otherwise bonded thereto. Such granules are formed of crushed tungsten carbide and may be distributed as cutters 260 over a leading surface 262 as depicted in FIGS. 1, 2 and 4 of the drawings in lieu of the natural diamonds depicted thereon, it being understood that the tungsten carbide granules may range in size from far larger to far smaller than the diamonds, it being understood that a suitable size may be selected based on characteristics of the formation being drilled. In lieu of tungsten carbide granules, a macrocrystalline tungsten carbide such as is employed for hardfacing on exterior surfaces of rock bits may be utilized if the formation characteristics are susceptible to cutting thereby. Use of such macrocrystalline material is disclosed in U.S. Pat. No. 5,492,186, assigned to the assignee of the present application, the disclosure of which is incorporated herein by this reference. Employing granules or macrocrystalline tungsten carbide affords the advantage of relatively inexpensive and easy refurbishment of the cutting structures in the field, rather than returning a bit to the factory.

Figure 11:
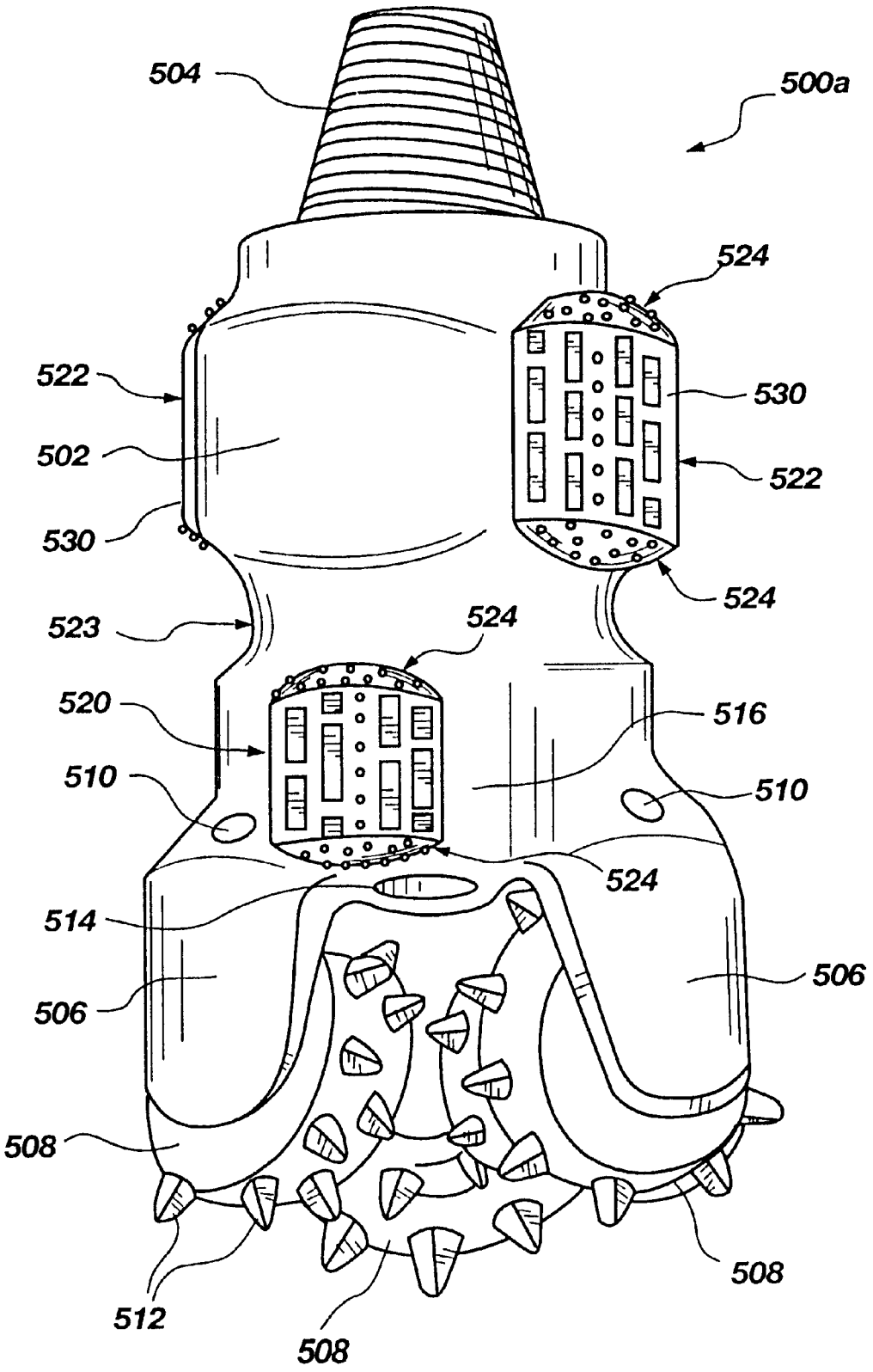
FIG. 11 is a schematic side perspective view of an exemplary rolling cone bit incorporating a first tandem arrangement of primary and secondary gage pads according to the present invention.
Figure 12:
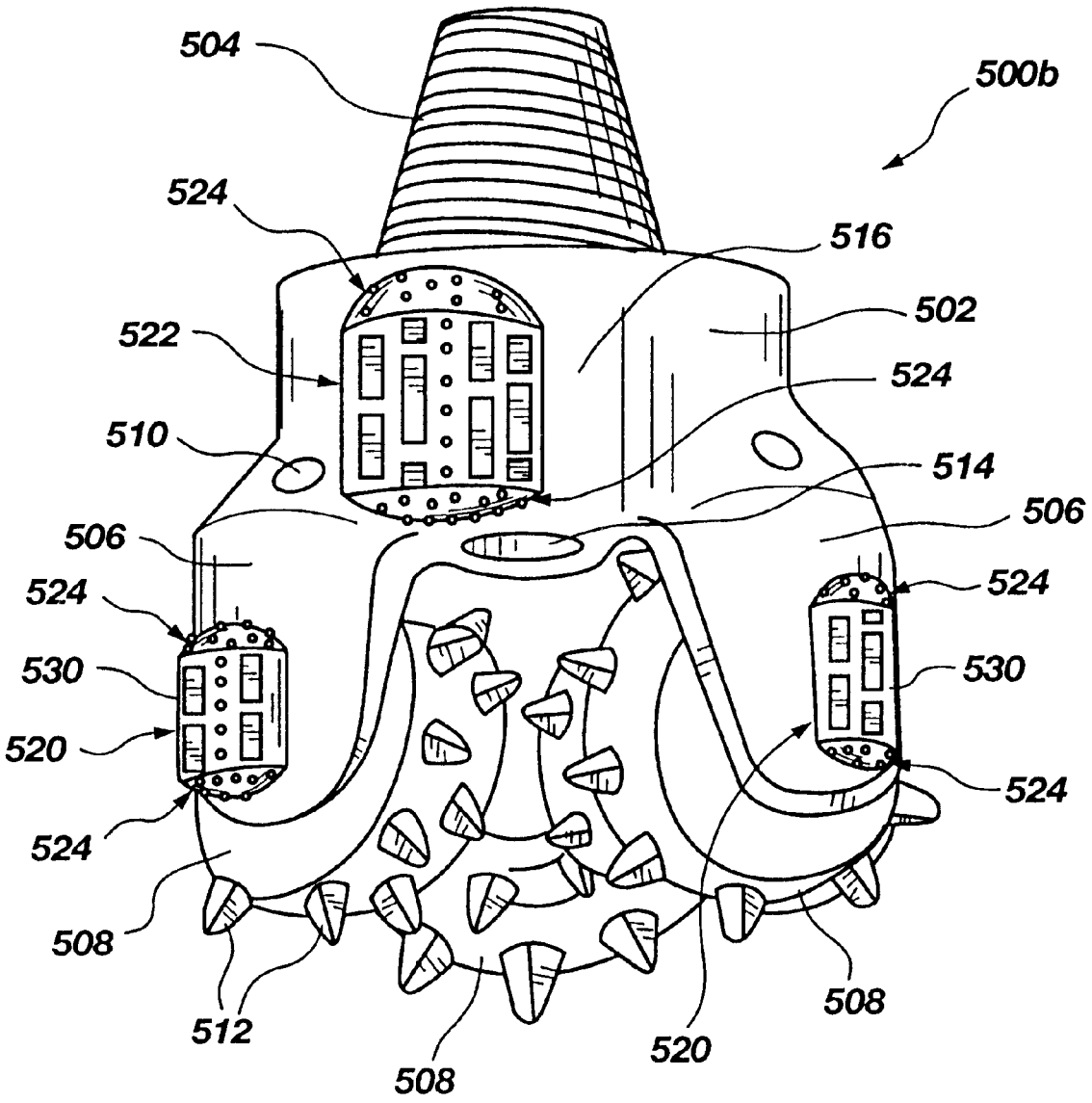
FIG. 12 is a schematic side perspective view of an exemplary rolling cone bit incorporating a second tandem arrangement of primary and secondary gage pads according to the present invention.
Figure 13:
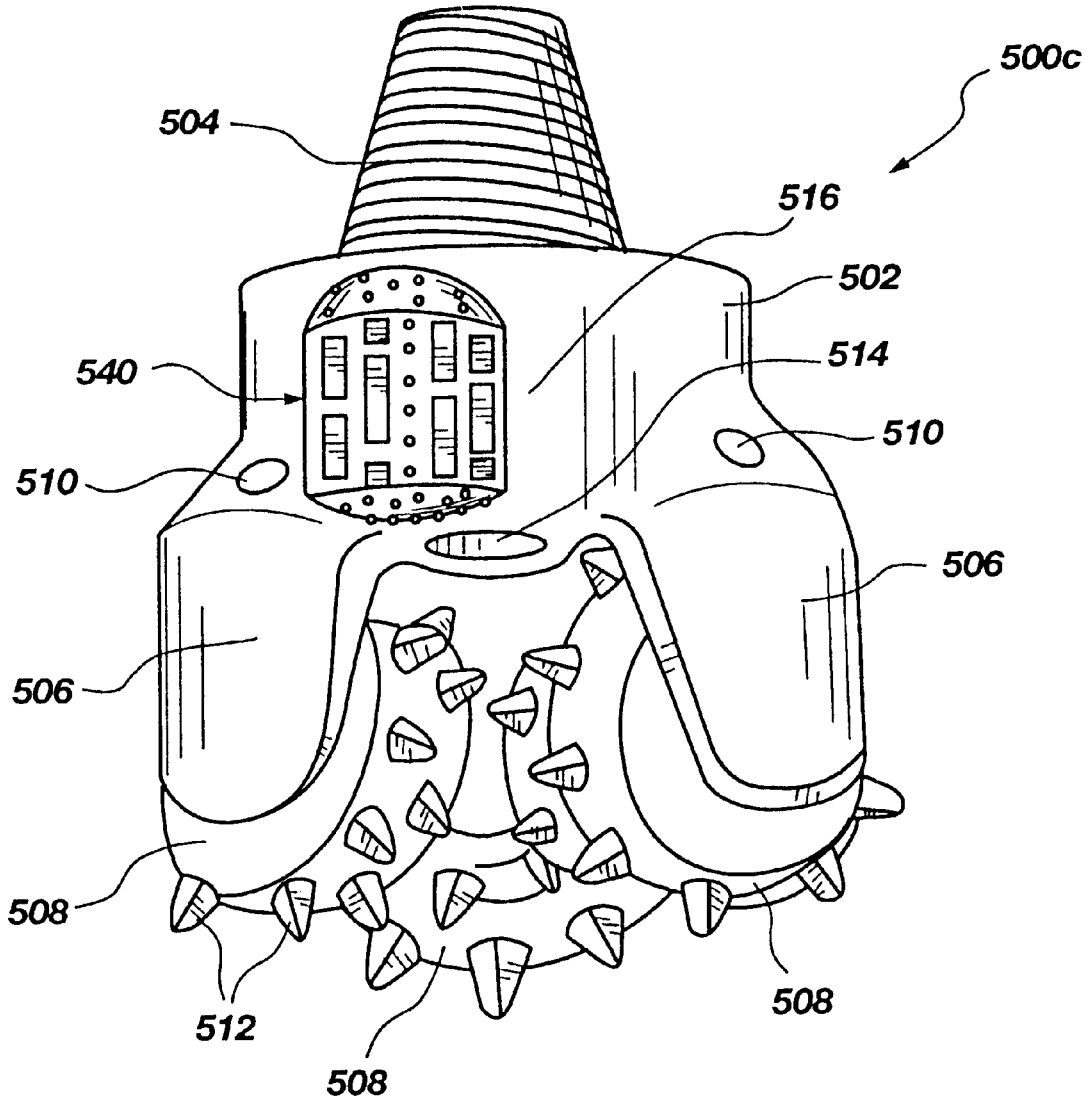
FIG. 13 is a schematic side perspective view of an exemplary rolling cone bit incorporating a third arrangement of a single group of supplementary gage pads according to the present invention in a single group above the legs of the bit.

Referring now to FIGS. 11 through 13 of the drawings, exemplary rolling cone, or "rock," bits 500*a*, 500*b* and 500*c* are shown. Each bit 500*a–c* includes a body 502 having a shank at one end thereof with a threaded pin as shown at 504 for connection to a drill string. Bit body 502 also includes three legs or sections 506 opposite threaded shank 504, each leg carrying a cone-shaped cutter 508 thereon at the leading end of the bit, cutters 508 being rotatably secured to a bearing shaft associated with each leg 506. Bearing lubrication is provided by a pressure-responsive lubricant compensator 510 located in each leg 506, as known in the art. The exteriors of cutters 508 may be configured (as in so-called "milled tooth" bits) to provide cutting structures thereon for engaging the rock formation being drilled, but are more typically provided with cutting structures 512 in the form of hard metal (such as cemented tungsten carbide) inserts retained in sockets and arranged in generally circumferential rows on each cutter 508. Nozzles 514 provide a drilling fluid flow to clear formation debris from cutters 508 for circulation to the surface via junk slots 516 between legs 506 leading to the annulus defined between the drill string and the borehole wall. The inserts may have exposed exterior ends comprising, or covered with, a superabrasive material such as diamond or cubic boron nitride. Rolling cone bits and their construction and operation being well known in the art, no further description thereof is necessary.

Referring now specifically to FIG. 11 of the drawings, bit 500*a* includes a group of primary gage pads 520 circumferentially disposed about body 502 above legs 506. As shown, primary gage pads 520 are located at least partially longitudinally above legs 506 and in junk slots 516. Primary gage pads 520 may be centered in junk slots 516, or positioned closer to one adjacent leg 506 or the other. Also as shown, secondary gage pads 522 are circumferentially disposed about body 502 and at least partially longitudinally above primary gage pads 520 and rotationally offset therefrom. Gage pads 520 and 522 may be configured as previously described herein, or in any other suitable configuration. An optional waist area 523 of reduced diameter may, as shown, be located between primary gage pads 520 and secondary gage pads 522 to enhance drilling fluid flow on the bit exterior and facilitate clearance of formation debris from the bit 500*a*. In such a design, it may also be possible, if desired, to rotationally or circumferentially align primary gage pads 520 and secondary gage pads 522 one above another as shown in FIG. 6 with respect to one drag bit embodiment of the invention. Both primary gage pads 520 and secondary gage pads 522 may be, and preferably are, provided with cutting structures 524 on their longitudinally leading and trailing surfaces, as in some of the preceding embodiments. Such an arrangement is desirable to provide the gage pads with the capability of removing ledges and other borehole wall irregularities while drilling the borehole and also to facilitate upward movement of the drill string in the borehole. Cutting structures 524 may comprise any of the previously-described gage pad cutting structures, or combinations thereof. As with the preceding embodiments, the cutting structures 524 do not project radially beyond the outer bearing surfaces 530 of the gage pads 520 and 522, and so do not provide any side-cutting capability. The radially outer bearing surfaces 530 of both primary gage pads 520 and secondary gage pads 522 are devoid of exposed cutters, and preferably comprise wear-resistant surfaces such as tungsten carbide, diamond grit-filled tungsten carbide, a ceramic, or other abrasion-resistant material as known in the art. The outer bearing surfaces 530 may also comprise discs, bricks or other inserts of wear-resistant material (see 252 in FIG. 4) bonded to the outer surface of the pads, or bonded into a surrounding powdered WC matrix material with a solidified liquid metal binder, as known in the art. The outer bearing surfaces 530 may also comprise a tungsten carbide hardfacing material such as is disclosed in the previously-referenced U.S. Pat. No. 5,663,512, or other, conventional, tungsten carbide-containing hardfacing materials known in the art. The outer bearing surfaces 530 of respective primary and secondary gage pads 520 and 522 may be rounded at a radius of curvature, taken from the centerline or longitudinal axis of the bit, substantially the same as (slightly smaller than) the gage diameter of the bit, if desired. Further, the secondary gage pads 520 may be sized to define a smaller diameter than the primary gage pads 522, and measurably smaller than the nominal or gage diameter of the bit 500*a*.

Referring now to FIG. 12, bit 50*b* is shown. Reference numerals designating features previously described in FIG. 11 are also employed in FIG. 12 for clarity. Bit 500*b* also includes groups of primary and secondary gage pads 520 and 522, respectively. As with bit 500*a*, the gage pads of each group are circumferentially disposed about body 502 and the two groups of pads are rotationally offset from one another. However, bit 500*b* differs from bit 500*a* in that the primary gage pads 520 are disposed on the exteriors of legs 506, while the secondary gage pads 522 are disposed in junk slots 516. Secondary gage pads 522 may be centered in junk slots 516, or located closer to either adjacent leg 506. Accordingly, bit 500*b* presents a more longitudinally compact structure, which may be desirable for extremely short radius directional drilling. Both primary and secondary gage pads 520 and 522 carry cutting structures 524 on their longitudinally leading and trailing surfaces to provide both down-drill and up-drill capabilities, and the radially outer bearing surfaces 530 of the pads may be structured as previously described with respect to bit 500*a*. As in bit 500*a*, the secondary gage pads 522 of bit 500*b* may be sized to define a smaller diameter than those defined by primary gage pads 520.

Referring now to FIG. 13, bit 500*c* is shown. Reference numerals designating features previously described with respect to bits 500*a* and 500*b* are also employed to describe bit 500*c* in FIG. 13 for clarity. Bit 500*c*, unlike bits 500*a* and 500*b*, employs only a single group of supplementary gage pads 540, located in junk slots 516 between legs 506 of body 502. Supplementary gage pads 540 may include cutting structures 524 on their longitudinally leading and trailing surfaces, and radially outer bearing surfaces 530 may be structured as previously described.

In each of the bits 500*a* through 500*c*, the increased contact area with the borehole wall provided by the respective gage pads 520, 522 and 540 may provide a benefit in terms of bit longevity by sharing inward thrust loads otherwise taken solely by the cutters 508 and their supporting bearing structures and associated seals.

While bits 500*a* through 500*c* have been illustrated and described as comprising so-called "tri-cone" bits, it will be understood by those of ordinary skill in the art that the invention is not so limited. Bits employing fewer than, or more than, three movable cutters to drill the borehole are also contemplated as falling within the scope of the present invention, as are bits which include both fixed and movable cutters to drill the borehole (i.e., bits having rotating cones or other cutters as well as fixed cutters such as PDC cutters on the bit face).

While the present invention has been described in light of the illustrated embodiment, those of ordinary skill in the art will understand and appreciate it is not so limited, and many additions, deletions and modifications may be effected to the invention as illustrated without departing from the scope of the invention as hereinafter claimed. For example, primary and secondary gage pads may be straight or curved, and may be oriented at an angle to the longitudinal axis of the bit, so as to define a series of helical segments about the lateral periphery thereof.

What is claimed is:

1. A rotary drill bit for drilling a subterranean formation, comprising:

a bit body having a longitudinal axis and extending radially outward therefrom toward a gage, the bit body carrying at least one movable cutter being movable with respect to the bit body and at a leading end thereof for cutting the subterranean formation and defining at least a majority of a borehole diameter therethrough; and a first plurality of circumferentially-spaced gage pads disposed about a periphery of the bit body and extending radially therefrom and longitudinally away from the leading end of the bit body, at least one of the circumferential spaced gage pads of the first plurality having a longitudinally leading surface carrying at least one cutting structure thereon having formation cutting capability.

2. The rotary drill bit of claim 1, wherein the at least one of the circumferentially-spaced gage pads of the first plurality include radially outer surfaces defining radially outer extents of the gage pads, and the at least one cutting structure carried by the longitudinally leading surface of the at least one circumferentially-spaced gage pad does not protrude radially substantially beyond the radially outer surface of the at least one circumferentially-spaced gage pad.

3. The rotary drill bit of claim 1, wherein the at least one cutting structure on the at least one circumferentially-spaced gage pad of the first plurality is selected from the group consisting of natural diamonds, PDC cutters, tungsten carbide inserts, diamond-coated tungsten carbide inserts, tungsten carbide granules, and macrocrystalline tungsten carbide.

4. The rotary drill bit of claim 1, wherein at least one of the circumferentially-spaced gage pads of the first plurality has a longitudinally trailing surface carrying at least one cutting structure thereon.

5. The rotary drill bit of claim 4, wherein the at least one cutting structure carried on the trailing surface of at least one circumferentially-spaced gage pad of the first plurality pads is selected from the group consisting of natural diamonds, PDC cutters, tungsten carbide inserts, diamond-coated tungsten carbide inserts, tungsten carbide granules, and macrocrystalline tungsten carbide.

6. The rotary drill bit of claim 1, further comprising a second plurality of circumferentially-spaced gage pads disposed about the periphery of the bit body and extending radially therefrom, at least a portion of each of the circumferentially-spaced gage pads of the second plurality longitudinally displaced from each of the circumferentially-spaced gage pads of the first plurality.

7. The rotary drill bit of claim 6, wherein at least one of the circumferentially-spaced gage pads of the second plurality has a longitudinally leading surface carrying a cutting structure thereon.

8. The rotary drill bit of claim 7, wherein the circumferentially-spaced gage pads of the second plurality include radially outer surfaces defining radially outer extents of the circumferentially-spaced gage pads, and the at least one cutting structure carried by the longitudinally leading surface of the at least one circumferentially-spaced gage pad of the second plurality does not protrude radially substantially beyond the radially outer surface of the at least one circumferentially-spaced gage pad of the second plurality.

9. The rotary drill bit of claim 8, wherein the cutting structure on the at least one circumferentially-spaced gage pad of the second plurality is selected from the group consisting of natural diamonds, PDC cutters, tungsten carbide inserts, diamond-coated tungsten carbide inserts, tungsten carbide granules, and macrocrystalline tungsten carbide.

10. The rotary drill bit of claim 6, wherein at least one of the circumferentially-spaced gage pads of the second plurality has a longitudinally trailing surface carrying at least one cutting structure thereon.

11. The rotary drill bit of claim 10, wherein the at least one cutting structure carried on the trailing surface of the at least one of the circumferentially-spaced gage pads of the second plurality is selected from the group consisting of natural diamonds, PDC cutters, tungsten carbide inserts, diamond-coated tungsten carbide inserts, tungsten carbide granules, and macrocrystalline tungsten carbide.

12. The rotary drill bit of claim 6, wherein the first plurality of circumferentially-spaced gage pads and the second plurality of circumferentially-spaced gage pads are in a mutual, non-overlapping, longitudinal relationship.

13. The rotary drill bit of claim 12, further including a waist portion of reduced diameter on the bit body intermediate the first and second pluralities of circumferentially-spaced gage pads.

14. The rotary drill bit of claim 6, wherein the gage pads of the second plurality are rotationally offset from the circumferentially-spaced gage pads of the first plurality.

15. The rotary drill bit of claim 6, wherein the first plurality of circumferentially-spaced gage pads and the second plurality of gage pads are equal in number.

16. The rotary drill bit of claim 1, wherein the bit body includes at least one leg projecting therefrom, the at least one circumferentially-spaced leg carrying the at least one movable cutter thereon.

17. The rotary drill bit of claim 16, wherein the at least one circumferentially-spaced leg comprises a plurality of circumferentially spaced legs, each leg carrying at least one movable cutter thereon.

18. The rotary drill bit of claim 17, wherein circumferentially-spaced the gage pads of the first plurality are located circumferentially between adjacent legs.

19. The rotary drill bit of claim 18, wherein at least one of the circumferentially-spaced gage pads of the first plurality is located closer to one circumferentially adjacent circumferentially-spaced leg than to another.

20. The rotary drill bit of claim 17, wherein the circumferentially-spaced gage pads of the first plurality are located on radially exterior surfaces of the circumferentially-spaced legs.

21. The rotary drill bit of claim 20, wherein each circumferentially-spaced leg carries one gage pad of the first plurality.

22. The rotary drill bit of claim 1, wherein the at least one movable cutter is rotatable and generally cone-shaped.

23. The rotary drill bit of claim 22, wherein the at least one movable cutter comprises a plurality of cutting structures disposed thereon.

24. A rotary drill bit for drilling a subterranean formation, comprising:

a bit body having a longitudinal axis and extending radially outward therefrom toward a gage, the bit body carrying at least one movable cutter being movable with respect to the bit body and at a leading end thereof for cutting the subterranean formation and defining at least a majority of a borehole diameter therethrough;

a first plurality of circumferentially-spaced gage pads disposed about a periphery of the bit body and extending radially therefrom and longitudinally away from the leading end of the bit body, at least one of the circumferentially-spaced gage pads of the first plurality having a longitudinally leading surface carrying at least one cutting structure having formation cutting capability; and a second plurality of circumferentially-spaced gage pads disposed about the periphery of the bit body and extending radially therefrom, and wherein at least a portion of each of the circumferentially-spaced gage pads of the second plurality being in a longitudinally non-overlapping relationship with the circumferentially-spaced gage pads of the first plurality.

25. The rotary drill bit of claim 24, wherein the circumferentially-spaced gage pads of the first plurality are longitudinally spaced from the circumferentially-spaced gage pads of the second plurality so as to be in a longitudinally non-overlapping relationship.

26. The rotary drill bit of claim 25, further including a waist of reduced diameter on the bit body longitudinally intermediate the first and the second pluralities of circumferentially-spaced gage pads.

27. The rotary drill bit of claim 24, wherein the gage pads of the second plurality are rotationally offset from the gage pads of the first plurality.

28. The rotary drill bit of claim 24, wherein the at least one movable cutter is rotatable and generally cone-shaped.

29. The rotary drill bit of claim 28, wherein the at least one movable cutter comprises a plurality of tooth-shaped cutting structures disposed thereon.

* * * * *